US005807228A

United States Patent [19]

Smithe et al.

[11] Patent Number: 5,807,228

[45] Date of Patent: Sep. 15, 1998

[54] SHEET FOLDING METHOD AND APPARATUS

[75] Inventors: Eliot S. Smithe; John W. Gardiner, both of Duncansville, Pa.

[73] Assignee: F. L. Smithe Machine Company, Inc., Duncansville, Pa.

[21] Appl. No.: 372,770

[22] Filed: Jan. 13, 1995

[51] Int. Cl.[6] ..... B31F 1/18

[52] U.S. Cl. ..... 493/438; 493/179; 493/248; 493/446

[58] Field of Search ..... 493/438, 439, 493/440, 446, 447, 455, 456, 248, 178, 179, 436, 197, 231

[56] References Cited

U.S. PATENT DOCUMENTS

| | | | |
|---|---|---|---|
| 780,559 | 1/1905 | Farmer | 493/456 |
| 1,851,061 | 3/1932 | Poppe . | |
| 1,931,155 | 10/1933 | Pearce | 493/392 |
| 2,054,832 | 9/1936 | Potdevin | 93/35 |
| 2,077,952 | 4/1937 | Novick | 93/62 |
| 2,088,805 | 8/1937 | Olm et al. . | |
| 2,269,954 | 1/1942 | Novick | 493/392 |
| 2,540,844 | 2/1951 | Strauss . | |
| 2,785,609 | 3/1957 | Billeb | 493/260 |
| 2,896,517 | 7/1959 | Labombarde | 493/436 |
| 3,069,982 | 12/1962 | Heywood et al. | 493/231 |
| 3,288,037 | 11/1966 | Burnett | 493/248 |
| 3,614,914 | 10/1971 | Troll | 493/130 |
| 3,893,381 | 7/1975 | Chapman et al. | 493/392 |
| 4,187,769 | 2/1980 | Bullock | 493/438 |
| 4,573,955 | 3/1986 | Mory et al. | 493/204 |
| 4,614,512 | 9/1986 | Capdeboscq | 493/441 |
| 4,994,010 | 2/1991 | Doderer-Winkler | 493/215 |
| 5,094,658 | 3/1992 | Smith et al. | 493/438 |
| 5,486,152 | 1/1996 | Heinz et al. | 493/438 |

*Primary Examiner*—Michael J. Carone
*Assistant Examiner*—Darren Ark
*Attorney, Agent, or Firm*—Price & Adams

[57] ABSTRACT

An envelope blank is conveyed by a transport system in an envelope making machine to a folding mechanism that folds one or more flaps of the blank. In folding a side flap, the leading edge of the blank adjacent to the score line is conveyed along a convex face of a plowshare. The plowshare face applies at the leading edge of the blank adjacent to the score line a force which bends the side flap through an angle of 180° to a position where the flap is folded to overlap the blank. A crease is formed on the score line to permanently set the flap on the blank. The folding of the flap is initiated by the convex face of the plowshare. Extending from the upper edge of the plowshare face is a grid-like network of flexible rods mounted to follow the helical path of the plowshare face. The free edge portion of the flap is supported by the grid to follow the flap leading edge being folded by the plowshare. The flap folding forces are applied at the region of the flap adjacent to the score line where the flap has the least resistance to bending. The folding forces are removed from the flap free edge which is supported by the grid to follow the movement of the flap leading edge. The trailing edge of the flap is stabilized by a guide plate positioned oppositely of the plowshare in the feed path. The guide plate prevents the flap trailing edge from falling downwardly ahead of the flap leading edge to assure that the fold is maintained in alignment with the score line.

17 Claims, 10 Drawing Sheets

SHEET FOLDING METHOD AND APPARATUS

BACKGROUND OF THE INVENTION

1. Field of the Invention

This invention relates to machinery for folding sheet material and, more particularly, to method and apparatus for folding sheet material in forming envelopes and the like.

2. Description of the Prior Art

In automated envelope forming operations, it is well known to utilize at one of the envelope forming stations a folding mechanism which folds a web of sheet material or blanks cut in preselected lengths. A common folding mechanism includes plowshare-type folding guides which extend a preselected length along the envelope feed line. The web of sheet material or cut blanks are conveyed through the plowshare folder by a vacuum table or a combination of overlying conveyors and pinch rolls.

U.S. Pat. No. 5,094,658 discloses a plowshare folder in an envelope forming machine where individual envelope blanks are conveyed through the folding mechanism by a vacuum table. The vacuum table includes a series of spaced apart conveyor belts that are driven over the surface of a vacuum table in the direction of feed of the blanks. The vacuum table includes a plate having apertures which draw in air as a result of a vacuum created by the evacuation of air from a vacuum plenum created below the surface of the vacuum plate. The plowshare folder includes a thin wall of rigid material having at the front end an initial planar surface which gradually bends in a 180° turn. Through the 180° turn, blades of the plowshare engage the seal flap region of the envelope blank. The flaps to be folded extend parallel to the axis of movement of the blank across the vacuum table and are folded into overlying relation with the main body of the blank.

As further disclosed in U.S. Pat. No. 5,094,658 a pair of plowshares are oppositely positioned in the feed line to simultaneously fold opposite side flaps. This operation is routinely performed in the formation of large open end envelopes.

U.S. Pat. No. 4,994,010 also discloses a machine for forming large open end envelopes having clasps to maintain the seal flaps of the envelope closed. Prior to attaching the clasp the lateral flaps of the blank are folded into overlapping relation to form the back side of the envelope. Then the clasp is attached to the folded flaps.

The folding operation in U.S. Pat. No. 4,994,010 is performed by a plowshare-type folding mechanism that includes fold loops and folding blades. During the folding operation, the lateral flaps converge and are glued together in an overlapping area by means of an adhesive layer which has been previously applied with the result that the folded and overlapping flaps form the back side of the envelope. The lateral flaps are simultaneously folded by folding blades which have an inner curvature that evolves from an initial point where the side flaps extend horizontally to a point where the flaps are folded in a tubular configuration. The guide surfaces of the folding blades curve progressively through 180° along travel of the blank.

The progressive folding of side flaps of an envelope blank in a plowshare-type folder is accomplished by the envelope blank advancing through zones of the folding blades. The curvature of the blades progressively changes from 0° to 180° through zones that extend in the direction of the feed line. The blades have a width which corresponds to the full width of the flap being folded. Consequently the entire surface of the flap being folded is in contact with the blades through the 180° folding.

During the progressive folding, the flap moves from a horizontal position at the 0° position through an angle of 180° to a position horizontally in overlying relation on the body of the blank. At the downstream end of the folding operation, the flap is moving downwardly to the 180° position while at the upstream end the flap is moving upwardly to the 90° position.

Over its entire length the flap is required to move in different directions during the folding operation. The sheet material forming the flap has a natural tendency to resist a change in direction of the fold. This resistance to folding introduces stress into the blank, making it difficult to maintain the fold aligned with the score line where the fold is to take place.

The nature of sheet material to resist bending or folding increases as the length of the blank being folded increases. U.S. Pat. Nos. 1,851,061 and 2,054,832 disclose plowshare-type folding mechanisms for envelope making machines in which the sheet material is folded before it is cut into segregated blanks for forming envelopes. The plowshare blades disclosed in these patents contact the full width of the flap being folded. At one point in the folding operation, the flap is bent upward toward 90° and at another point the flap is folded downwardly toward 180°. Particularly for an extended length of sheet material being folded the sheet material resists folding which can result in misalignment of the fold at the score line.

In U.S. Pat. No. 2,077,952, individual blanks are cut from a continuous web and then folded by the provision of upwardly inclined converging arms which serve to turn the side flaps through approximately a quadrant. Downstream of the converging arms a pair of belts act on the flaps. Active stretches of the belts are twisted from substantially upright to horizontal positions to fold the flaps into overlying relationship with the body of the envelope blank.

With the envelope making machine disclosed in U.S. Pat. No. 2,077,952 and the other patents discussed above, the folding mechanisms attempt to support the entire width of the flap being folded. Consequently folding forces are directed at the free edge of the flap a distance substantially removed from the score line where the fold is to be formed. Particularly for envelopes with large flaps to be folded, the folding process commences at even a greater distance from the score line. Therefore, the greater the width of material in contact with the folding device and the further the folding operation commences from the score line, the greater the difficulty in maintaining the fold aligned with the score line.

Therefore, there is need in sheet folding machinery, such as envelope forming machines, for apparatus that initiates the folding operation and applies the folding forces closely adjacent to the score line. The free edge of the flap should be supported as the fold is accomplished without applying the folding forces to the flap free edge.

SUMMARY OF THE INVENTION

In accordance with the present invention, there is provided sheet folding apparatus that includes transport means for linearly advancing a sheet of material in a feed path. Folding means positioned above the transport means fold an edge portion of the sheet material to form a flap in the sheet material as the sheet material advances in the feed path. A receiving end portion and a discharge end portion of the folding means are spaced a preselected distance apart in the feed path where the sheet material is folded through an angle of 180° from the receiving end portion to the discharge end portion. A guide bar extends between the receiving end portion and the discharge end portion. The guide bar has a base with a longitudinally extending folding edge positioned in parallel overlying relation with a score line for locating the fold of the sheet material. A face of the guide bar extends upwardly from the folding edge at a preselected angle to form a profile evolving in a helical path the length of the guide bar from 0° at the receiving end portion to 180° at the discharge end portion to urge a leading edge of the sheet edge portion into contact with the folding edge to fold the sheet edge portion along the score line to form the flap. Means extending upwardly at a preselected angle from the guide bar face support a free edge of the sheet edge portion and direct the free edge to follow the sheet edge portion being folded on the score line.

Further in accordance with the present invention, there is provided a method for folding sheet material that comprises the steps of linearly advancing a sheet of material for folding in a feed path. Folding means is positioned in the feed path to fold an edge portion of the advancing sheet material along a longitudinally extending score line to form a flap in the sheet material. The sheet material is fed with a score line maintained in contact with a folding face of the folding means. The folding face is directed in a helical path commencing at 0° at the beginning of the fold to 180° at the end of the fold to form the flap on the score line. A free edge of the sheet material extending above the folding face is supported to follow the helical path of the folding face as the sheet material is folded along the score line. A fold in the body of the sheet material is initiated at the point where the folding face engages the score line with the sheet free edge following the direction of the fold as the edge portion advances on the folding face in the helical path.

Accordingly, a principal object of the present invention is to provide method and apparatus for folding sheet material along a score line where the folding forces are applied to the sheet material closely adjacent to the score line and the free edge of the sheet follows the direction of the fold to insure that the fold is maintained in alignment with the score line.

Another object of the present invention is to provide an envelope blank folding mechanism that includes a folding edge positioned in overlying relation with the score line of an envelope blank and following a helical path to initiate folding of the envelope blank at the score line with the remainder of the flap portion following the direction of fold at the score line.

A further object of the present invention is to provide a folding mechanism for forming a side flap in an envelope blank where the flap is folded along the score line by advancing the blank into contact with the edge of a folding surface that follows a helical path and the body of the blank removed from the score line is supported to follow the direction of fold.

Another object of the present invention is to provide method and apparatus for forming flaps in an envelope blank where the flap is folded on a score line by initiating the fold closely adjacent to the score line and the remaining portion of the flap follows the direction of the fold.

These and other objects of the present invention will be more completely disclosed and described in the following specification, the accompanying drawings, and the appended claims.

DESCRIPTION OF THE PREFERRED EMBODIMENTS

Figure 1:
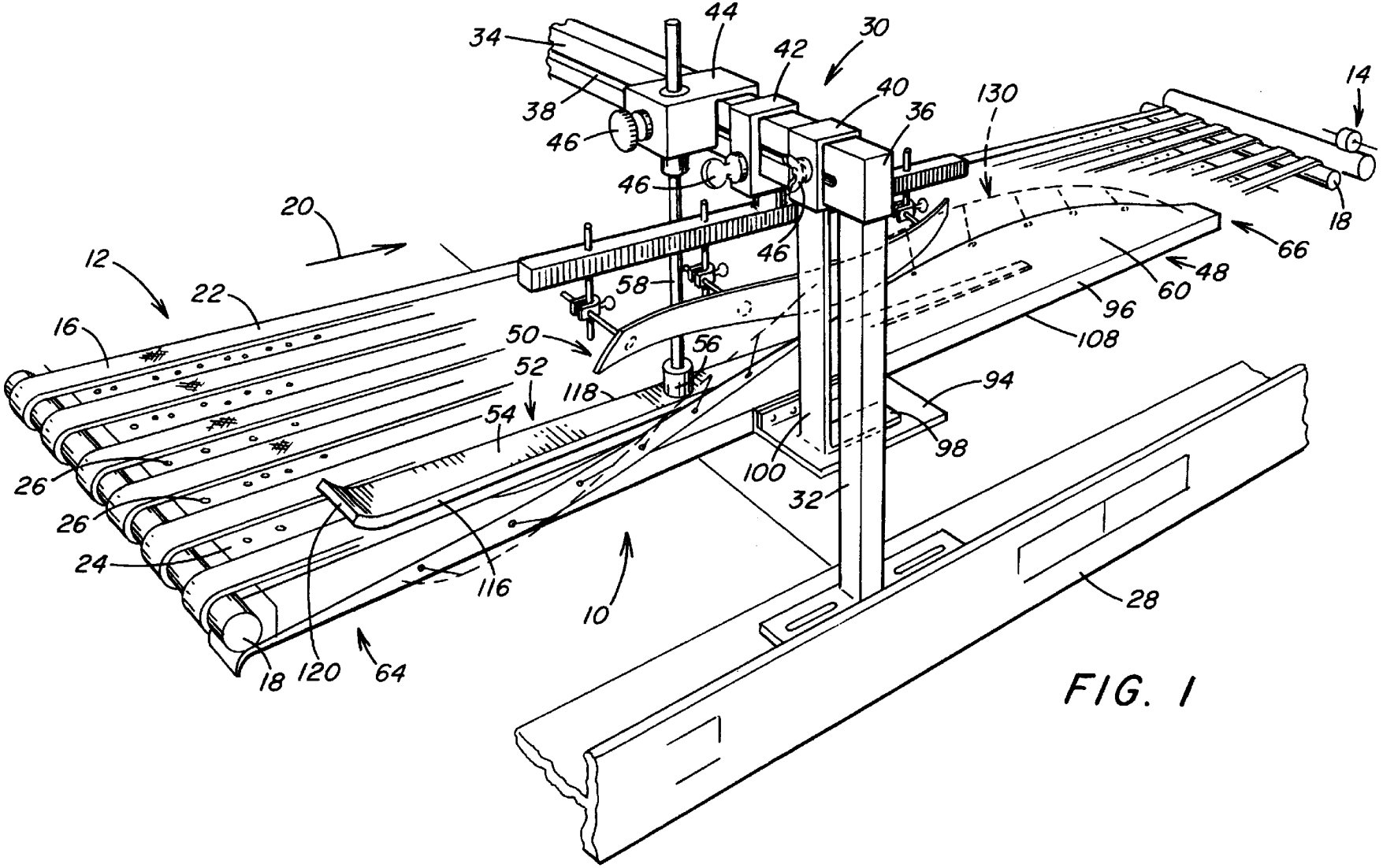
FIG. 1 is a fragmentary isometric view of a folding mechanism of an envelope forming machine, illustrating a plowshare-type folding device for forming a flap in an envelope blank.

Referring to the drawings and particularly to FIG. 1, there is illustrated a folding mechanism generally designated by the numeral 10 for forming envelopes from blanks of sheet material cut from a continuous web of material fed through an envelope forming machine. The details of the envelope forming machine are beyond the scope of the present invention which is limited to the folding mechanism 12. In a conventional envelope forming machine, individual blanks of sheet material are fed from a stack in a feed line through a number of different stations.

Envelopes are formed from blanks or sheet material cut from a web which is first fed to a printing station where a selected portion of both sides of the blank are printed. The printing is followed by the formation of score lines along the top and bottom edges of the blank. From the scoring mechanism, the blanks are moved to a seal gummer. Following the application of adhesive to the flaps to be folded, the blanks are conveyed by a suitable transport device generally designated by the numeral 12 in FIG. 1 through the folding mechanism 10.

The folding mechanism 10 folds the side seam of the blank. A folding mechanism for folding only one flap of the blank is shown in FIG. 1. A duplicate folding mechanism is provided on the opposite side of the machine for simultaneously folding opposite side flaps into overlying relation with the body of the envelope blank. From the folding mechanism 10, the blanks are fed through creasing rollers generally designated by the numeral 14 that complete the folding operation. From the creasing rollers 14 the envelope blanks are fed to additional folding mechanisms to fold the seal flaps and subsequent stations to complete the envelope forming operation. The formed envelopes are then fed to a delivery station for stacking of the completely formed envelopes in preselected quantities for shipment.

The transport system 12 for advancing the blanks in a longitudinal feed path through the folding mechanism 10 includes, as illustrated in FIG. 1, a vacuum table formed by a plurality of parallel continuous endless belts 16. The belts 16 extend around rollers 18 which are driven by suitable drive mechanisms (not shown). The belts 16 are rotated to advance the spaced apart envelope blanks in the feed path identified by the arrow 20.

Each belt 16 includes an upper conveying surface 22 which is positioned above the surface of a vacuum table 24. The vacuum table 24 is suitably supported by the envelope machine frame and includes a plurality of apertures 26. Air is drawn through the apertures 26 by a vacuum created by the evacuation of air from a vacuum box positioned below the table 24. The vacuum box is connected by pipes to a vacuum creating mechanism (not shown). Details of a suitable vacuum table for use with the present invention are disclosed in U.S. Pat. No. 5,094,658 which is incorporated herein by reference.

As the belts 16 are driven above the surface of the vacuum table 24, the vacuum force is applied to the envelope blanks to frictionally engage the blanks to the surface 22 of the belts 16. The belts 16 advance in the direction of the feed path indicated by the arrow 20 through the folding mechanism 10. The vacuum force is exerted at a magnitude to maintain the blanks fixed on the belts 16 so that when the blanks pass through the folding mechanism 10 the edge portions of the blanks are folded along the desired score line.

PLOWSHARE SUPPORT FRAME

The folding mechanism 10 is supported by a frame 28 of the envelope machine above the surface of the transport system 12. The folding mechanism 10 is mounted on a bridge generally designated by the numeral 30 which is connected to and extends upwardly from the frame 28 and transversely across the feed path above the vacuum table 24. It should be understood that the end portions of the bridge 30 are connected to the machine frame 28. For clarity of illustration only, one end portion of the bridge 30 is shown connected to the frame 28 in FIG. 1. An identical connection of the bridge 30 to the frame 28 is provided on the opposite side of the transport system 12.

The bridge 30 supports the folding mechanism 10 for adjustment above the transport system 12 in three directions. The folding mechanism 10 is vertically and horizontally adjustable in a direction transverse to the feed path 20. In addition, the folding mechanism 10 is angularly adjustable about an axis vertical to the vacuum table 24. The bridge 30 includes at its opposite ends an upright member 32 which is suitably bolted to the frame 28. A support beam 34 is connected at end portions 36 to the upper end of member 32 to extend transversely to the longitudinal axis of the transport system 12.

The support beam 34 includes a longitudinally extending slot 38 that extends substantially the length of the beam 34. A plurality of guides 40, 42, and 44 are mounted on the beam 34 for slidable movement along the length of the beam. Each guide 40, 42, 44 includes an adjustable fastening device 46 that extends through the respective guide into locking engagement with the slot 38. Advancing the fastening device 46 through the guide into the slot 38 fixes the guide in position on the beam 34. To move the respective guides 40–44 to a desired position along the length of the beam 34, the fastening device 46 is loosened to permit the guide to slide to the desired position on the beam.

The guide 40 is connected to a plowshare-type folder generally designated by the numeral 48. The plowshare folder 48 folds the envelope blank along a score line as will be described later in greater detail. By adjusting the position of the guide 40 on the beam 34, the plowshare folder 48 is positioned to receive a selected size of envelope blank for folding as it is conveyed along the feed path 20 on the transport system 12.

A sheet control guide generally designated by a numeral 50 is similarly supported above the transport system 12 by the guide 42 for movement along the length of the beam 34. The sheet control guide 50 is positioned laterally and above the plowshare 48. The control guide 50 stabilizes movement of the blank trailing edge as the leading edge of the blank is engaged by the plowshare 48 to fold the blank on the score line.

A forming blade generally designated by the numeral 52 is adjustably positioned on the support beam 34 by connection to the guide 44. The forming blade 52 includes an elongated bar 54 that is positioned to extend the length of the plowshare 48 at a preselected angle thereto. The bar 54 is connected to a coupling 56 extending between the bar 54 and a rod 58 that extends through the guide 44. The rod 58 is supported for rotational movement in the guide 44 and includes conventional means for locking the rod in a desired position to adjust the angular position of the forming blade bar 54 relative to the plowshare 48. The lateral position of the bar 54 is also adjustable relative to the plowshare 48 by loosening the fastening device 46 to slide the guide 44 in the slot 38 to a desired position on the beam 34.

PLOWSHARE FOLDER

As illustrated in FIGS. 1–4 the plowshare folder 48 extends parallel to the direction of feed of the envelope blanks on the transport system 12. The plowshare 48 includes an elongated guide bar 60 having a longitudinally extending folding edge 62 parallel to the feed path 20 of the envelope blanks on the transport system 12. The folding mechanism 10 of the present invention is adjustable relative to the conveying surface of the transport system 12 to position the folding edge 62 at the desired location to fold the blank along a score line for a wide range of blank sizes at high speed, for example 300 envelopes per minute, through the folding mechanism 10.

To accommodate variations in the width of the flap to be folded on the blank, the guide bar 60 is adjustable laterally relative to the conveying surface 22. The folding edge 62 is positioned in substantially overlying relation with the score line on the envelope blank that defines the location of the fold in the blank to form a flap of desired width. Further, the length of the plowshare 48 permits flaps of a substantial length to be folded on each envelope blank as they are conveyed on the transport system 12.

Figure 3:
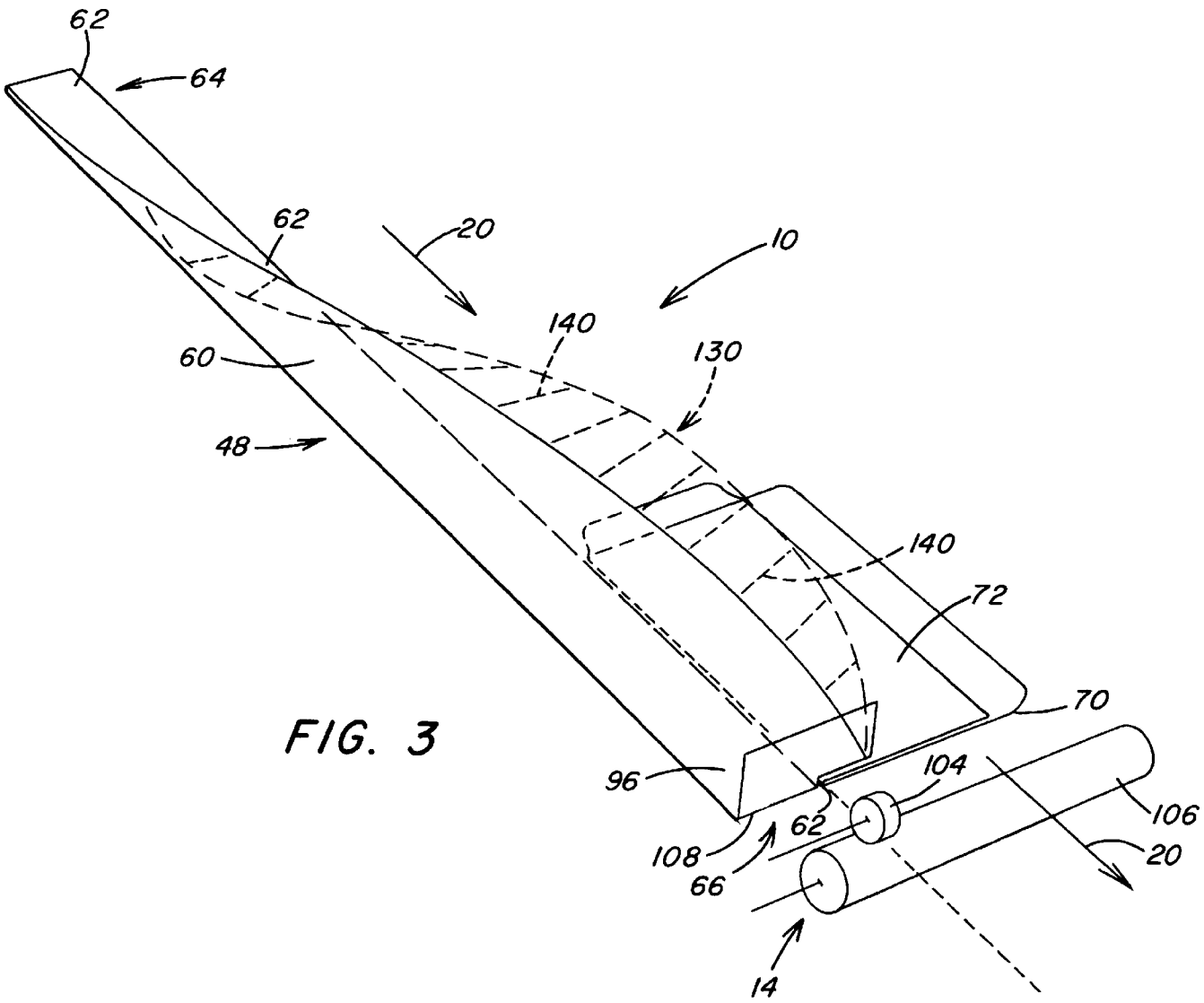
FIG. 3 is a further isometric view of the plowshare folder, schematically illustrating a pinch roll assembly at the discharge end of the plowshare.
Figure 4:
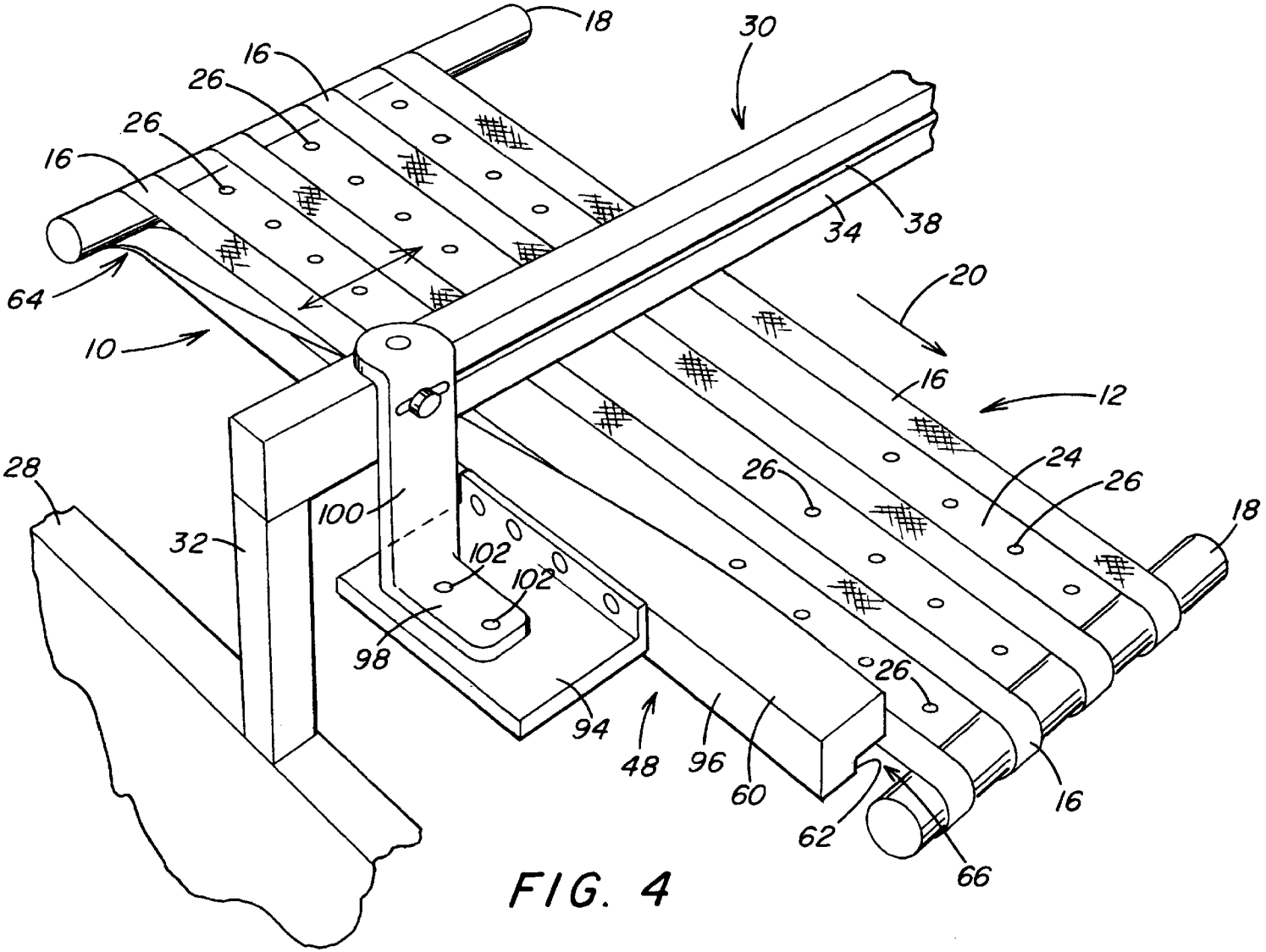
FIG. 4 is a fragmentary isometric view, illustrating the adjustable mounting of the plowshare on the conveyor in the envelope feed path.

As further illustrated in FIGS. 1 and 4, the guide bar 60 forming the plowshare folder 48 extends substantially the length of the upper surfaces 22 of the endless belts 16 between the rollers 18 supporting the conveyor belt 16. The guide bar 60 has a receiving end portion generally designated by the numeral 64 where envelope blanks are first engaged by the bar folding edge 62. A discharge end portion generally designated by the numeral 66 defines the end of the plowshare 48 where the folding operation is completed. As shown in FIG. 3, a flap 72 is folded into overlying relation with the body of envelope blank 70 at the plowshare receiving end portion 66.

Figure 5:
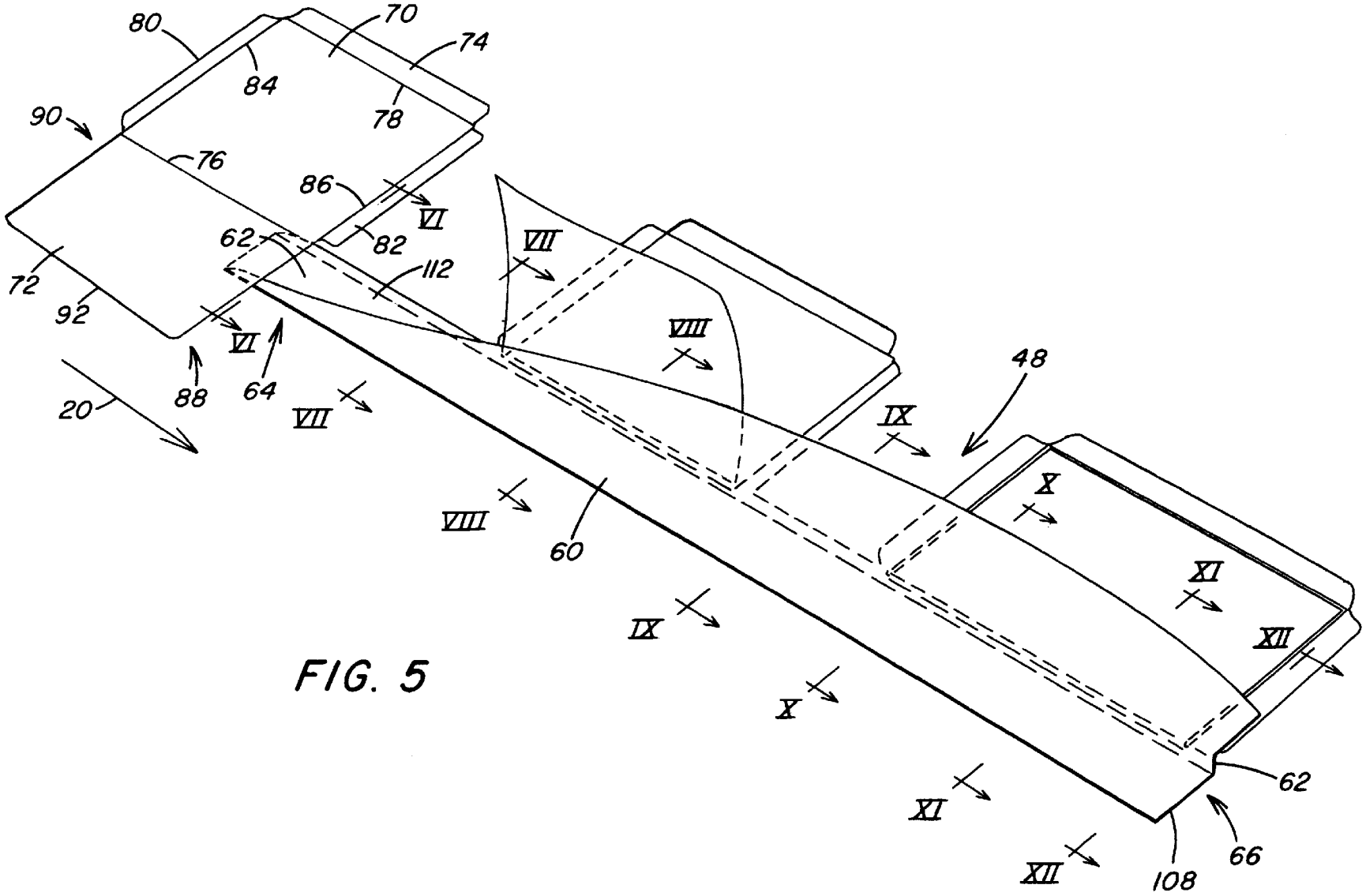
FIG. 5 is an isometric view of the progressive folding of the envelope blank by the plowshare, schematically illustrating the blank folding from an initial position of the flap at 0°, upwardly to 90°, and then downwardly to 180° where the fold is completed.
Figure 6:
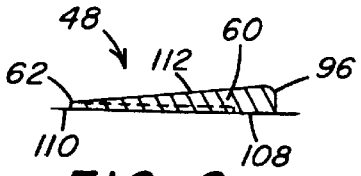
FIGS. 6–12 are schematic sectional views of the plowshare taken at selected points in the feed line shown in FIG. 5, illustrating the helical path followed by the plowshare edge from 0° at the receiving end portion shown in FIG. 6 to 180° at the discharge end portion shown in FIG. 12.

FIG. 5 illustrates three of the series of steps in the folding sequence in which an unfolded blank 70 is conveyed by the transport system 12 to the receiving end portion 64 of the folding mechanism 10. One example of an envelope blank 70 is shown in FIG. 5 which has been formed by the envelope machine to include a body portion having a pair of side flaps 72 and 74 defined by score lines 76 and 78 respectively. A pair of end flaps 80 and 82 are separated from the envelope blank body portion by score lines 84 and 86. Also prior to conveying the unfolded envelope blank 70 to the folding mechanism 10, the side flaps 72 and 74 and end flaps 80 and 82 are applied with a suitable adhesive for sealing the flaps in folded position.

The envelope blank 70 is advanced to the folding device 10 in the direction indicated by the arrow 20 in FIGS. 1 and 5. With the blank 70 conveyed in the direction 20, a leading edge generally designated by the numeral 88 of the flap 72 first engages the receiving end portion 64 of the guide bar 60. A trailing edge generally designated by the numeral 90 of the flap 72 follows the flap leading edge 88 in the folding process.

In accordance with the present invention, the leading edge 88 of the flap 72 is acted upon by the folding edge 62 of the plowshare guide bar 60 at the score line 76. Folding of the flap 72 is accomplished by the plowshare folding edge 62 applying folding forces along the score line 76 which is the weakest point on the blank 70 to resist folding. The flap trailing edge 90 does not engage the plowshare folding edge 62 nor does a free edge 92 of the flap 72 engage the folding edge 62. As it will be explained later in greater detail, the free edge 92 of the flap 72 and the trailing edge 90 follow the folding movement of the flap leading edge 88 at the score line 76.

As shown in FIGS. 1 and 4 the plowshare 48 is supported by the bridge 30 at a selected elevation above the transport system 12 so that the leading edge 88 of the envelope blank 70 engages the guide bar folding edge 62 in alignment with the side flap score line 76. The plowshare 48 is adjustably connected to the bridge 30 by the provision of an angle bracket 94 bolted to a rear vertical face 96 of the guide bar 60. The bracket 94 receives a base 98 of a support arm 100 that is suitably connected to the beam 34 for longitudinal movement along the length thereof and vertically relative thereto. With this arrangement, the guide bar 60 is vertically and transversely movable relative to the surface of the transport system 12. This allows the folding edge 62 of the plowshare 48 to be positioned for engaging the leading edge 88 of the blank 70 to fold the flap 72 precisely on the score line 76.

Not only is the plowshare 48 vertically and transversely movable relative to the longitudinal feed path 20, it is also angularly movable relative thereto by the feature of removably bolting the support arm base 98 to the angle bracket 94. As illustrated in FIG. 4 the support arm base 98 includes a pair of holes 102 that are aligned with selected holes or a slot (not shown) in the angle bracket 94. A plurality of holes or a slot is provided on the angle bracket 94 to permit variations in the position of the base 98 on the bracket 94. Bolts extend through the holes 102 to securely connect the support arm 100 to the bracket 94.

As seen in FIG. 4, the support arm base 98 is connected to the bracket 94 with the edge of the base extending substantially parallel to the edge of the bracket 94. However, the base 98 is positioned angularly displaced from the position shown in FIG. 4 on the bracket 94 to angularly displace the folding edge 62 of the plowshare 48 relative to the longitudinal feed path 20 of the envelope blank. With the above described apparatus, the plowshare folding edge 62 is adjustably positioned relative to the score line 76. Regardless the width of the flap to be folded, the plowshare folding edge 62 is positioned in alignment with the flap score line to fold the flap along the score line.

PLOWSHARE FOLDING EDGE

As illustrated in FIGS. 1, 3 and 5, the plowshare folding device 10 is supported by the bridge 30 to position the guide bar folding edge 62 parallel to the center line of the envelope machine and in axial alignment with the score line of the envelope blank. For example, the folding edge 62 is aligned with the score line 76 about which the side flap 72 is to be folded. The plowshare 48 is adjusted on the bridge 30 to align the folding edge 62 at the receiving end portion 64 of the folding mechanism 10 with the score line 76. The folding edge 62 of the guide bar 60 extends the complete longitudinal length of the folding mechanism 10 from the receiving end portion 64 to the discharge end portion 66 as shown in FIGS. 3 and 5.

At the receiving end portion 64, the envelope blank is introduced to the folding mechanism with unfolded flaps. As the blank 70 advances the length of the plowshare 48 a flap, for example the side flap 72, is folded on the score line 76 into overlying relation with the body of the envelope blank by the time the blank reaches the discharge end portion 66. From the discharge end portion 66, as illustrated in FIG. 3, the folded blank 70 is conveyed by the transport system 12 to the creasing rollers 14. A pinch roller 104 is mounted in overlying and frictional engagement with a driven roller 106. With this arrangement, the folded envelope blank 70 is advanced from the discharge end 66 of the folding mechanism 10 into the bight formed between the rollers 104 and 106.

As the folded envelope blank passes between the rollers 104 and 106, the folded edge of the flap at the score line 76 passes between the rollers to complete and set the fold in the envelope blank at the score line 76. The creasing rollers 14 close the flap 72 in a tightly folded position on the blank 70. Preferably the creasing rollers 14 are spaced a preselected distance downstream of the plowshare discharge end 66 so as to avoid jamming of the blanks as they pass through the folding device 10. From the creasing rollers 14, the envelope blanks 72 are conveyed to subsequent stations to complete the folding of the blank.

Figure 2:
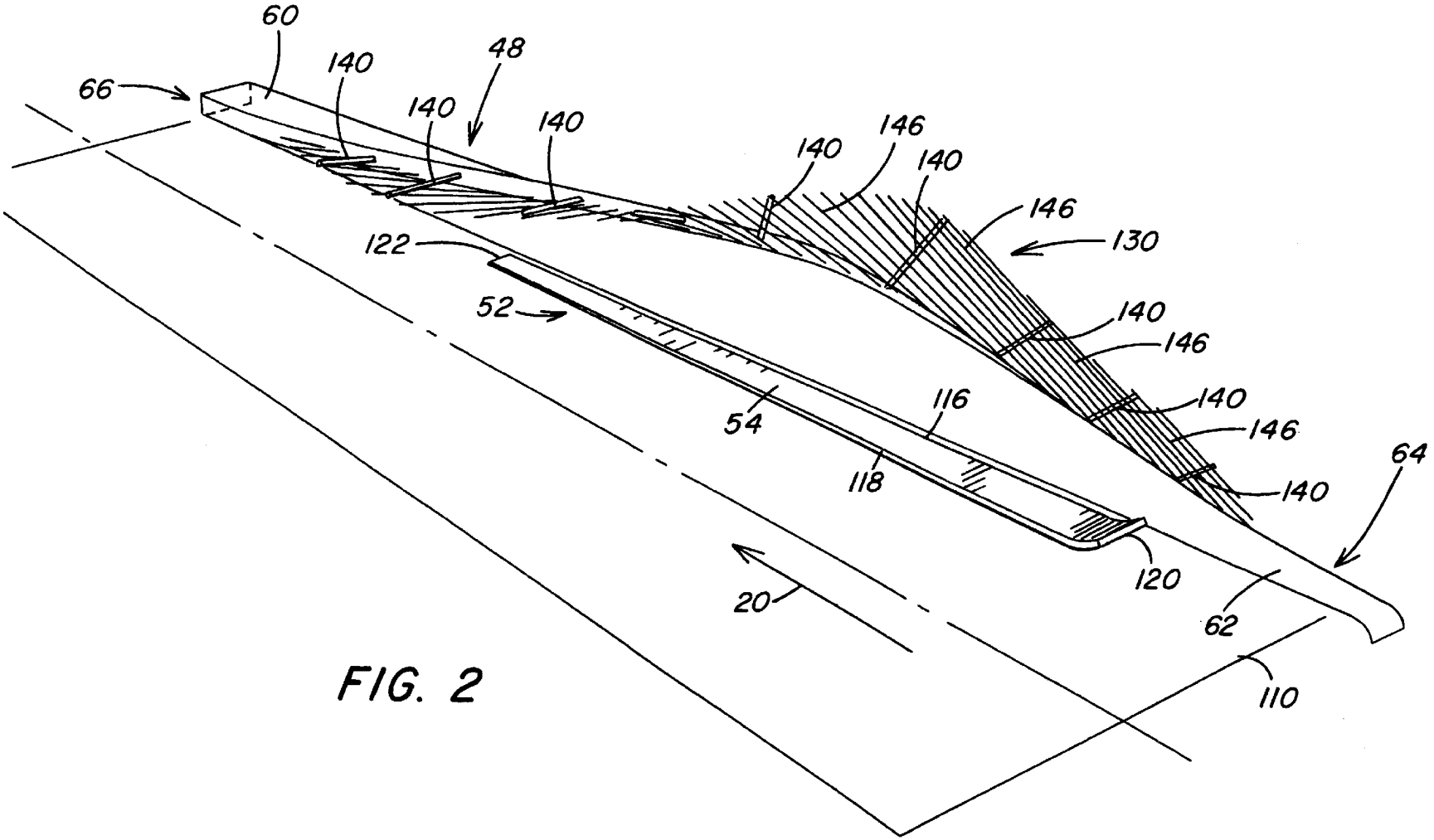
FIG. 2 is a schematic isometric view of the folding mechanism shown in FIG. 1, illustrating a plowshare extending in a helical path and a guide assembly that follows the helical path to support the blank being folded.

As illustrated in FIGS. 1–2 the plowshare 48 includes the elongated guide bar 60 having a base 108 that extends perpendicularly relative to the rear vertical face 96. The base 108 extends from its intersection with the rear vertical face 96 laterally a preselected width to the folding edge 62. The plowshare 48 is supported by the bridge 30 so that the base 108 is positioned coplanar with a plane 110, schematically illustrated in FIG. 2, of the envelope blank 70 positioned on the transport system 12.

Positioning the plowshare base 108 in the plane 110 of the envelope blank 70 assures that the folding edge 62 of the plowshare acts upon the blank leading edge 88 in alignment with the score line 76. The longitudinal edge forming the folding edge 62 extends parallel to the center line of the envelope machine and in coaxial arrangement with the score line 76 where the fold is to be executed on the blank 70. As further illustrated in FIG. 2, the forming blade 52 in the embodiment of a longitudinally extending bar 54 is supported by the rod 58 connected to the bridge 30. As shown in FIG. 1, the bar 54 is supported in a preselected position adjacent to and extending at an angle relative to the plowshare folding edge 62.

During the folding operation, the side flap 72 moves from a planar position at the plowshare receiving end portion 64 upwardly and downwardly to a folded planar position at the receiving end portion 66. During this movement through an angle of 180°, an upward lifting force is applied to the body of the blank conveyed by the transport system 12. If the body of the blank is lifted from the surface of the transport system 12, the driving force on the blank is reduced thereby reducing the feed rate of the envelope blank. This causes the envelope blank 70 to be misaligned on the transport system 12 and prevents a precise fold of the flap 72 along the score line 76.

To prevent the blank 70 from being lifted from the transport system 12 as the flap 72 is being folded, the blank 70 passes in the plane 110 (FIG. 2) beneath the bar 54. Thus the body of the blank adjacent to the score line 76 is maintained in driving contact with the transport system 12. This assures that the blank 70 is maintained in the required aligned position on the transport system 12 relative to the plowshare folding edge 62 and travels at the required speed for formation of the fold on the score line 76.

PLOWSHARE HELICAL FACE

As illustrated in FIG. 5, the plowshare folding device 48 acts on the leading edge 88 of the flap 72 to be folded. The blank 70 is conveyed in the feed path 20 to the plowshare 48 which is supported by the bridge 30 in a position where the folding edge 62 is positioned in substantially axial alignment with the score line 76 about which the flap 72 is folded. As the blank 70 is conveyed into contact with the folding edge 62, the leading edge 88 at the score line 76 is lifted from the planar position of the blank 70 shown in FIG. 5, which is at an angle of 0° relative to the plane 110 of the transport system 12, upwardly and then downwardly through an angle of 180° at the discharge end 66 of the plowshare 48. The flap 72 is folded on the score line 76 in overlying relation with the body of the envelope blank 70.

The progressive lifting of the blank 70 through an angle of 180° relative to the plane 110 of the blank on the conveying surface of the belts 16 is accomplished by a convex face 112 of the guide bar 60. The convex face 112 extends upwardly from the folding edge 62 at an angle of 0° with respect to the plane of the envelope blank 70. The angle the face 112 forms with the horizontal plane 110 changes progressively along the length of the plowshare 48 from an initial angle of 0° to an angle of 180° at the plowshare discharge end portion 66. The face 112 of the plowshare 48 follows a longitudinal helical path as it progresses through the 180° angular displacement.

As seen in FIG. 5, the convex face 112 displaces the leading edge 88 of the envelope blank at the flap 72 through an angle of 180° to fold the flap 72. The leading edge 88 follows the profile of the face 112 from the receiving end portion 64 at 0° to the discharge end portion 66 at 180°. During the folding sequence, the trailing edge 90 of the flap 72 follows the angular displacement of leading edge 88. The flap trailing edge 90 does not come in contact with the folding edge 62 or the profile face 112 of the plowshare 48. Similarly, the flap free edge 92 is not acted upon by the folding edge 62 or face 112.

The free edge 92 of the blank flap 72 follows the direction of movement of the flap leading edge 88 as it is folded so that the entire flap 72 moves through an angle of 180°. However through the entire range of movement of the flap, the folding forces are exerted upon the flap at the leading edge 88 adjacent to the score line 76 by the provision of the plowshare 48 to insure that the fold is aligned with the score line 76.

As illustrated in FIG. 5, the folding operation progresses through an angle of 180°0. The seal flap 72 is engaged by the profile face 112 of the plowshare 48 in a position coplanar with the envelope blank 70 at the receiving end portion 64. As the blank 70 advances along the plowshare 48, the body of the blank 70 remains in contact with the surface of the transport system 12 by the provision of the forming blade 52 (FIG. 2).

The side flap 72 is lifted from a substantially horizontal position upwardly to a vertical position extending 90° from the plane of the transport system at approximately the midpoint of the plowshare 48. Thereafter, the flap 72 moves downwardly toward the surface of the blank 70 to where the flap 72 is positioned in overlying relation with the blank 70 at the discharge end portion 66. Thus, a fold in the envelope blank 70 is formed on the score line 76.

The folding of the side flap 72 through an angle of 180° is accomplished by extending the face 112 along a helical path that varies in length based upon the nature of the folding operation being performed. For example, in one envelope machine the length of the helical path followed by the flap 72 extends approximately 6 feet. Over this length the flap 72 is folded through an angle of 180°.

The fold is initiated by the change in the angle of the plowshare face 112 from the receiving end portion 64 to the discharge end portion 66. The rate of change in the angle with the face 112 varies over the length of the bar 60. The rate of change is not constant so that flap 72 is initially lifted rapidly from the 0° position to the 90° position, as illustrated in FIG. 5, over a distance less than one half of the bar 60. From the 90° position, the flap 72 is folded downwardly to a horizontal position on the blank 70.

It should be understood that any rate of rise of the flap along the length of the plowshare 48 can be controlled by the angle formed on the face 112. One factor in determining the rate of rise in the side flap 72 from the 0° position is the length of the plowshare 48, which length is determined in part by the structure of the envelope forming machine.

The helical path followed by the face 112 of the plowshare 48 between 0° and 180° is schematically illustrated in FIGS. 2, 3 and 5. In FIGS. 6–12 sectional views of the plowshare 48 are illustrated along the length thereof from the receiving end portion 64 in FIG. 6 to the discharge end portion 66 in FIG. 12. As described above, the plowshare 48 is in the configuration of a bar 60 which guides the flap leading edge 88 on the profile face 112 to fold the flap on the score line 76. In accordance with the present invention, the flap is folded on or as closely as possible to the score line 76.

The folding operation is initiated in the body of the flap 72 adjacent to the score line 76. The folding forces on the flap 72 are not concentrated at the free edge 92 of the flap 72. The convex face 112 acts on the flap 72 adjacent to the score line 76. As a result, the body of the flap 72 adjacent to the score line 76 initiates the folding movement of the flap 72. The free edge 92 of the flap 72 follows the direction of fold initiated at the score line 76. This assures that the flap 72 is not misfolded where the fold is displaced from alignment with the score line 76. This problem is encountered with the prior art devices that initiate folding the flap 72 by the application of forces at the flap free edge 92.

With conventional plowshare-type folding devices used in envelope forming machines, the fold is initiated at the free edge of the flap. This requires that the folding force be applied at the furthest possible point from the score line 76. This results in folding the blank into a tubular configuration, trapping a substantial volume of air inside the flap. In this configuration, stability of the blank on the transport system is reduced. Consequently the blank can become misaligned with respect to the plowshare and the flap not folded on the score line. This problem is aggravated at machine speeds in excess of 300 envelopes per minute and with larger size envelope blanks.

An envelope blank has a natural tendency to resist folding. When the folding is initiated a substantial distance from the weakest point of the blank, the fold has a greater tendency to be misaligned from the score line. The present invention, on the other hand, initiates fold of the flap at the weakest point of the flap which is on the score line. The plowshare profile face 112 initiates the fold at the score line so that the flap breaks across the score line prior to the flap free edge 92. By maintaining the flap 72 in contact with the folding edge 62 the adverse effects of creating a pocket of air within the folded flap are eliminated.

The structure of the plowshare 48 that provides for improved folding of an envelope blank includes an elongated bar 60 having a base 108 of a substantially constant width along its entire length. Extending upwardly from the base 108 on one side of the bar 60 is the rear vertical face 96. The base 108 includes on the side adjacent to the feed path the folding edge 62. The edge 62 extends the entire length of the plowshare from the receiving end portion 64 to the discharge end portion 66 as illustrated in FIGS. 6–12.

Figure 12:
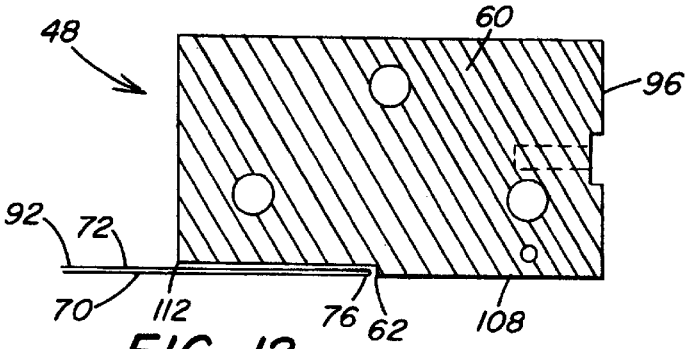

The folding edge 62 is maintained substantially in the plane 110 of the envelope blank 70 on the transport system 12. From the folding edge 62 the plowshare includes the profile face 112 which extends upwardly from the edge 62 to the rear vertical face 96. In accordance with the present invention, profile face 112 is positioned at an angle with respect to the plane 110. The angle evolves through a helices beginning at substantially 0° illustrated in FIG. 6 to 180° as illustrated in FIG. 12. At substantially the midpoint in the plowshare 48 between the receiving end portion 64 and the discharge end portion 66 the profile face 112 approaches an angle of 90° with the plane 110.

Figure 8:
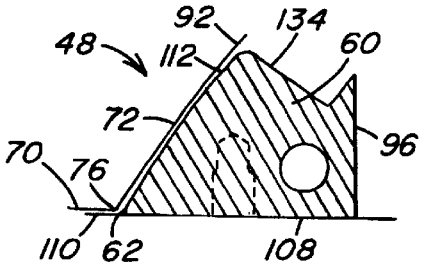
Figure 9:
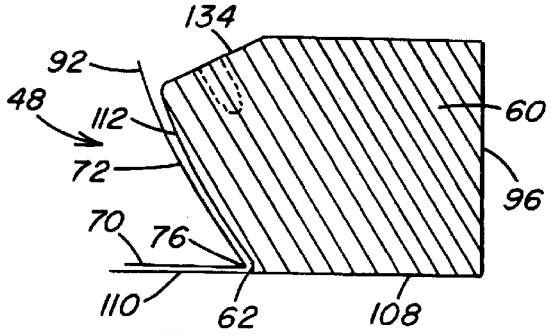

FIG. 8 illustrates the profile face at a point along the plowshare 48 before the flap 72 reaches an angle of 90° with respect to the plane 110. FIG. 9 illustrates the profile face 112 at an angle which urges the flap 72 downwardly toward the body of the blank 70 after the flap has passed through an angle of 90° with respect to the plane 110. During the travel of the envelope blank from the 0° position to the 90° position, the flap 72 is moved upwardly from the surface of the transport system 12. At the 90° point the profile face 112 moves the flap 72 downwardly toward the body of the blank 70.

As seen in FIGS. 6–12 the profile face 112 follows a helical path from one end of the plowshare 48 to the other. The angle the profile face 112 makes with the plane 110 of the envelope blank progressively varies from 0° to 180°. The rate at which the angle of the profile face 112 rises from 0° to 90° and from 90° to 180° is substantially uniform along the length of the plowshare 48. In one embodiment the rate of rise from 0° to 90° takes place over a shorter length of the plowshare 48 than the rate at which the angle falls from 90° to 180°.

The rate of rise and the rate of fall of the angle of the profile face 112 between 0° and 180° is selective based on such factors as the machine speed, length of the envelope blank, and width of the flap to be folded. For example, in one embodiment of a plowshare having a length of 76⅝ inches the angle of the profile face 112 rises 60° in a first 24 inch section. In a second 24 inch section, the face 112 moves an angle of 60° to 120°. In a third 24 inch section the profile face 112 moves through an angle of 120° to 180°. The profile face along a length of 4⅝ inches is maintained at 180° or in a position parallel to the plane 110 of the blank 70 on the transport system 12.

Figure 7:
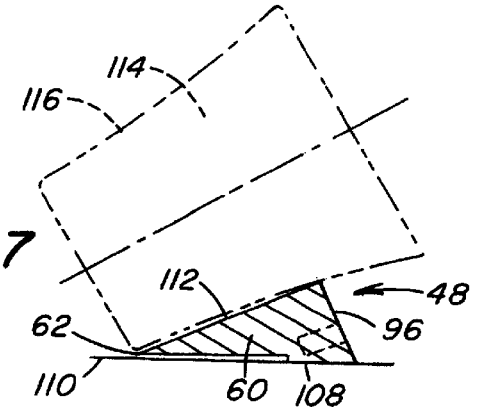

As schematically illustrated in FIG. 7, the angle of the profile face 112 of the plowshare 48 is formed by an end mill tool 114. As known in the art, the tool 114 has a cutting surface 116 with a concave radial surface which forms the face 112 having a convex radial configuration. In one embodiment the radius of curvature of the profile face 112 is 8 inches. The angle at which the face 112 is cut in the body of the bar 60 with respect to the base 108 determines the angle formed by the face 112 with the plane 110 of the envelope blank 70. The angle at which the face 112 is formed is controlled by the relative position of the end mill tool 114 during the cutting operation.

FIG. 7 schematically illustrates the angle at which the tool 114 is positioned to cut the face 112 at an angle which is positioned in the feed path 20 at a point on the plowshare 48 downstream a short distance from the plowshare receiving end portion 64, as illustrated in FIG. 5. As discussed above FIG. 8 illustrates a section of the plowshare taken at a point where the flap 72 is continuing to rise from the plane 110 of the envelope blank 70 toward the vertical position. It should be pointed out that while the angle formed by the profile face 112 with the blank plane 110 evolves progressively through a helix, the convex configuration of the face 112 along its length remains at a fixed radius, for example 8 inches.

The convex configuration of the profile face 112 serves to initiate the folding movement of the blank 72 closely adjacent to the score line 76. The folding forces exerted on the flap 72 are thus concentrated at the weakest point on the flap which is along the score line 76. The folding forces are not exerted at the flap free edge 92 to initiate the folding.

With the provision of the present invention of commencing folding of the flap 72 adjacent to the score line 76, the free edge 92 follows the movement of the flap as it is being folded. A folding force need not be applied to the free edge 92. In fact, the free edge 92 does not come in contact with the active surface of the face 112. In this respect, the convex shape of the plowshare face 112 initiates folding of the flap 72 at the flap leading edge 88 adjacent to the score line 76. The fold is then broken at the score line 76 and not at a point substantially removed therefrom, such as at the flap free edge 92.

Figure 10:
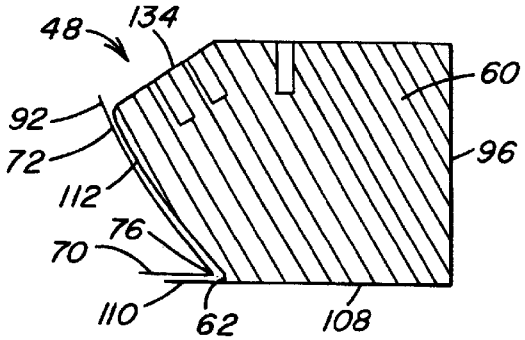
Figure 11:
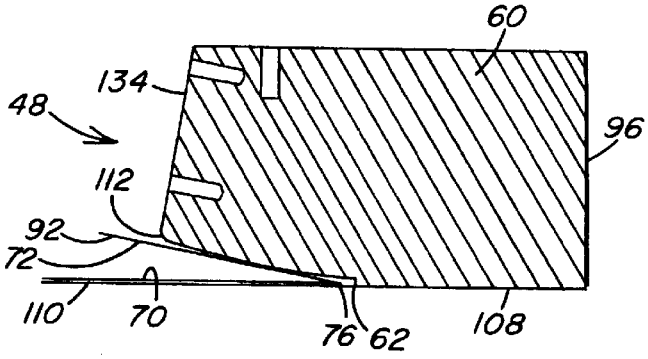

In the folding cycle between 0° and 90°, the profile face 112 vertically raises the flap 72 from the plane 110 of the envelope blank 70. FIGS. 9–11 illustrate the progressive movement of the flap 72 as it is urged downwardly from the 90° position. During this cycle of movement of the flap 72 the convex configuration of the face 112 in combination with the forming edge 62 serves to maintain the bending forces applied to the flap 72 closely adjacent to the score line 76. This results in the portion of the flap adjacent to the score line 76 leading the folding operation. The flap free edge 92 follows the movement of the flap leading edge 88. FIG. 12 illustrates the completion of the fold at the discharge end portion 66 where the face 112 is parallel to the plane 110 of the blank 70. The flap 72 is thus folded into overlying relation with the blank 70 along the score line 76.

The provision of the plowshare 48 having a convex profile face 112 extending upwardly from the folding edge 62 to initiate the fold closely adjacent to the score line 76 departs from the folding method and apparatus described above for the prior art. With the prior art devices, the plowshare blade initiates the fold by bending the blank into a tubular configuration. At high feed rates, the prior art approach results in misfolding of the blank. The flap is not folded on the desired score line.

The present invention overcomes the problems encountered with the prior art by utilizing a plowshare with a convex face extending upwardly from a folding edge where the forces for folding the flap are concentrated closely adjacent to the score line. Precision in forming the fold is achieved by concentrating the bending forces applied to the flap at the point where the flap is the weakest to resist bending, which is along the score line. With the bending force applied to the leading edge of the flap, the fold follows the score line.

FORMING BLADE

Another factor that contributes to precision in folding a seal flap and prevents misfolding in the present invention is maintaining the blank in a preselected position on the transport system 12 with respect to the folding edge 62 of the plowshare 48. If the blank 70 moves from a desired position on the transport system 12 as it advances through the folding mechanism 10, the flap 72 is misfolded. As described above, the transport system 12 includes a vacuum table or a series of overlying drive rolls.

It is essential that the body of the envelope blank 70 remain in contact with the transport system so that the feed rate of the envelope blanks through the folding mechanism 10 remains constant. If the feed rate should deviate as the blank advances through the folding mechanism 10, the flap will be misfolded. The flap is first lifted vertically from the plane of the envelope blank and then turned in an opposite direction to complete the fold. An upward lifting movement is imparted to the body of the envelope blank.

Lifting the blank from the conveying surface 22 reduces the surface area of the envelope blank in contact with the conveying surface. This results in a reduction in the feed rate of the blank through the folding mechanism. To overcome the natural tendency of the blank to be raised from the conveying surface as it is being folded, the present invention utilizes the forming blade 52 to maintain the blank in contact with the conveying surface and the score line 76 positioned opposite the folding edge 62 of the plowshare 48.

As schematically illustrated in FIGS. 1 and 2 and in further detail in FIGS. 13–17, the forming blade 52 has an elongated configuration in the shape of a relatively thin bar 54 having a fixed width along its length. The bar 54 forms a breaking edge opposite the score line 76 of the envelope blank 70 to facilitate folding the flap 72 by the plowshare 48. The bar 54 maintains the body of the envelope blank 70 adjacent to the score line 76 in contact with the conveying surface 22.

The bar 54 has longitudinally extending edges 116 and 118 where the edge 116 is positioned oppositely of the plowshare folding edge 62. The bar 54 has an upturned receiving end portion 120 raised above the plane 110 of the envelope blank 70. The raised end portion 120 permits the leading edge 88 of the envelope blank 70 on the transport system 12 to pass beneath the bar 54. A discharge end portion 122 is provided at the opposite end of the bar 54 from which the body of the envelope blank 70 passes.

The bar 54 is supported above and closely adjacent to the surface of the transport system 12 by the rod 58 adjustably connected to the guide 44 which is slidably positioned on the bridge 30, as above described and illustrated in FIG. 1. The bar 54 is positioned non-parallel relative to the plowshare 48. The bar edge 116 converges toward the plowshare edge 62 in the direction from the receiving end portion 120 to the discharge end portion 122. In other words, the discharge end portion 122 of the bar 54 is closer to the plowshare edge 62 than the bar receiving end portion 120. The angular position of the bar 54 relative to the longitudinal edge of the plowshare 48 is schematically illustrated in FIGS. 13–17.

Figure 13:
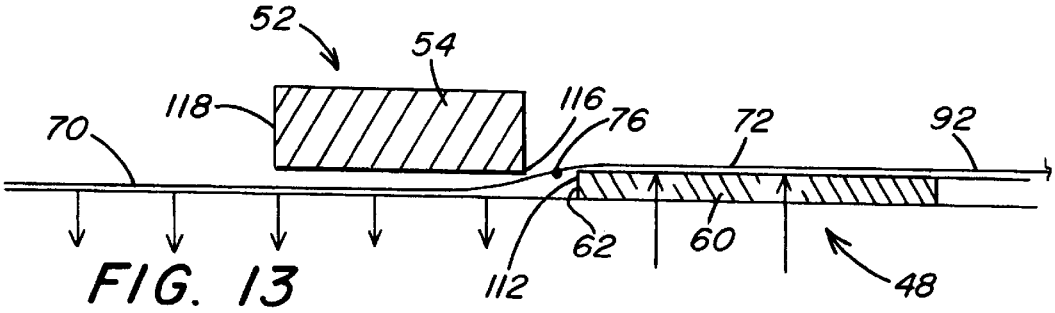
FIGS. 13–17 are schematic sectional views of the plowshare at selected points during the folding operation, illustrating a forming blade positioned oppositely of the plowshare in overlying relation with the blank closely adjacent to the score line.
Figure 14:
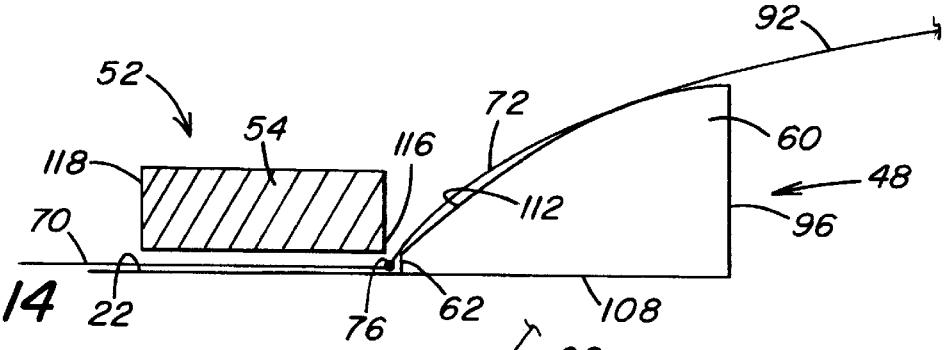

As illustrated in FIG. 13, the forming blade 52 is suspended above the surface of the envelope blank 70 to permit the blank to pass under the bar 54. The bar 54 maintains the blank in contact with the transport system 12 to overcome the tendency of the blank 70 to be lifted from the conveying surface 22 as the flap 72 is folded by the plowshare 48. As shown in FIG. 14, the edge 116 of the bar 54 exerts a downward force on the body of the envelope blank adjacent to the score line 76. This prevents a reduction in the conveying force applied to the blank 70 when the flap 72 is lifted from the conveying surface.

Figure 15:
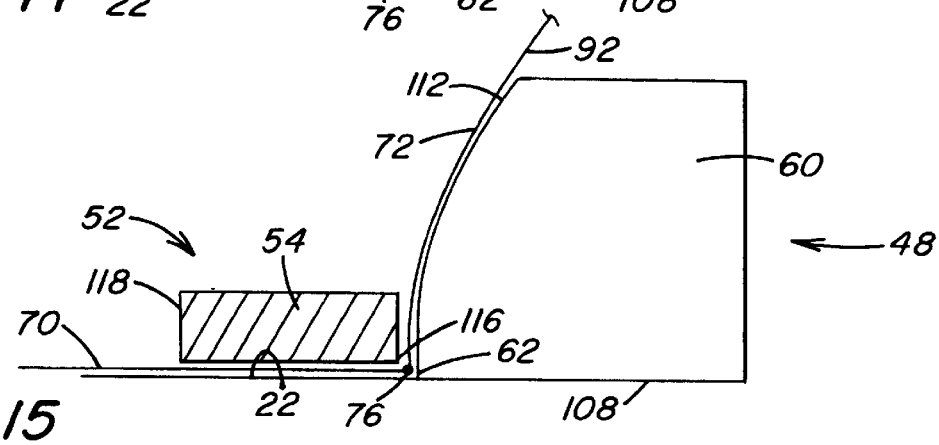

As shown in FIGS. 14 and 15, the blank 70 progresses along the plowshare 48 and the flap 72 is raised from the plane 110 of the blank 70. The edge 116 of the bar 54 progresses closer and closer to the score line 76 to resist the lifting forces applied to the blank 70. During the folding cycle between 0° to 90° the lifting forces on the blank 70 are the greatest. To counter the lifting forces the bar 54 maintains the body of the envelope blank 70 in contact with the transport system 12 and in close proximity to the score line 76. The flap 72 is caught between the convex face 62 of the plowshare 48 and the longitudinal edge 116 of forming blade 52.

As illustrated in FIGS. 13–15 the forming blade 52 has a rectangular cross section from the receiving end portion 120 a preselected length along the bar 54 to the point approximately where the profile of the plowshare face 112 begins to bend the side flap 72 downwardly from the 90° position. During this folding cycle the flap 72 moves upwardly from the plane 110 and a lifting force is applied to the body of the envelope blank 70 adjacent to the score line 76. Unless the body of the envelope blank 70 is restrained from being lifted upwardly with the flap 72, the conveying force applied to the blank 70 is decreased. This results in a decrease in the feed rate of the blank on the transport system 12 and subsequent misfolding of the flap 72.

With the present invention, the upward movement of the blank is restrained by the edge 116 of the bar 54 positioned adjacent to the score line 76. The bar 54 traps the envelope blank 70 in close proximity to the score line 76 and maintains the blank in contact with the conveying surface 22. This serves to maintain the feed rate of the envelope blanks on the transport system 12 constant.

When the blanks reach the point in the folding cycle where the flap 72 is positioned at the 90° angle the plowshare face 112 commences the helical path from 90° to 180°. During this cycle, the flap 92 moves downwardly toward the blank on the conveying surface 22. Thus after the 90° point in the helical folding path, the face 112 applies a downward force upon the flap 72. During the first 90° cycle in the helical path the forming blade 62 operates in combination with the plowshare profile face 112 to break or fold the flap 72 about the score line 76.

At the 90° point, the fold is partially formed in the blank 70. The flap 72 follows the fold as it is urged downwardly through the second 90° cycle of folding. Once a crease is formed in the blank along the score line 76, the flap 72 moves downwardly about the crease to complete the folding operation. The folding cycle is schematically illustrated in FIGS. 8–18.

Figure 16:
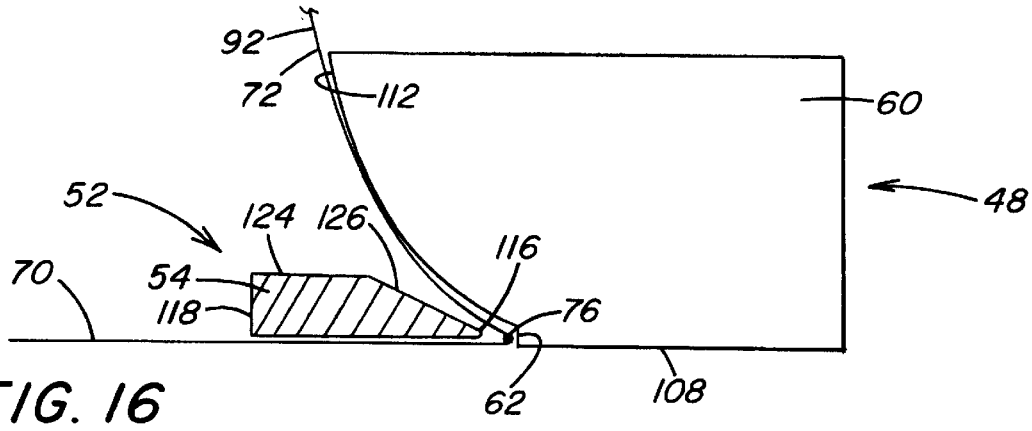
Figure 17:
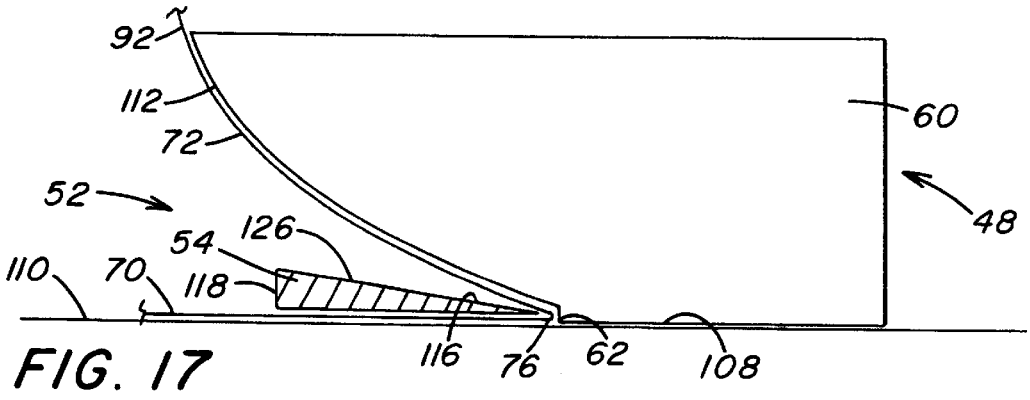

To facilitate creasing or completion of the flap folding, the edge 116 of the forming blade 52 progresses closer and closer to the plowshare folding edge 62 at the discharge end 66 of the plowshare 48. At the discharge end portion 122 of the forming blade 52, the edge 116 is located at its closest position opposite the folding edge 62. As shown in FIGS. 16 and 17, the fold at the score line 76 passes through a wedged shaped opening formed by bar edge 116 converging toward the plowshare folding edge 62. This wedging effect is achieved with the forming bar 52 positioned in non-parallel relation to the plowshare folding edge 62.

At the point along the forming blade 52 where the flap 72 is moved to the 90° position and a crease formed in the flap 72 along the score line 76, a top surface 124 of the bar 54 is provided with a beveled edge 126, as shown in FIG. 16. The beveled edge 126 extends upwardly at an angle from the edge 116 to the bar top surface 124. The beveled edge 126 of the forming blade 52 begins on the bar 54 at a point opposite the plowshare 48 where the flap trailing edge 90 has passed the 90° angle. From this point to the completion of the fold, the trailing edge 90 falls downwardly behind the leading edge 88 toward the surface of the envelope blank 70.

FIG. 16 illustrates an early point in the downward folding of the flap 72 where the bar 54 is beveled on surface 126. As the beveled edge 126 progresses toward the bar discharge end portion 122, the angle of the bevel decreases. This arrangement is shown in FIG. 17 where the beveled edge 126 extends the full width of the top of the bar from the edge 116 to the edge 118. A bevel of this angle is required adjacent the discharge end portion 122 of the bar 54 to provide the necessary clearance for the flap 72 to pass beneath the profile face 112 as illustrated in FIG. 17.

Figure 18:
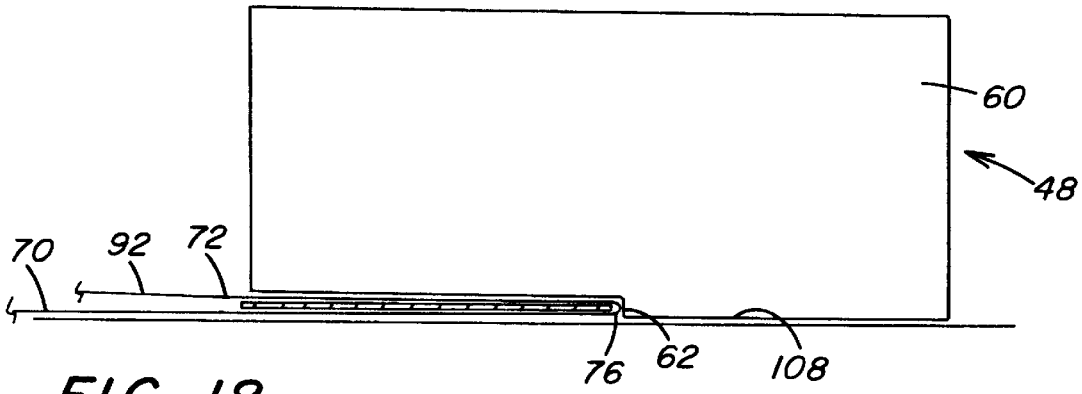
FIG. 18 is a schematic sectional view of the plowshare, illustrating completion of the fold downstream of the forming blade.

The discharge end 122 of the bar 54 is spaced upstream from the point where the plowshare face 112 is positioned at an angle of 180°, as shown in FIG. 18. At the 180° position in the folding cycle, the flap 72 is closed. The end of the bar 54 is positioned upstream of this point so as not to interfere with the closing of the flap 72 onto the envelope blank 70. Once the flap 72 is closed, the blank 70 is advanced beyond the discharge end 66 of the plowshare 48. At this point, the blank 70 enters the creasing rollers 14 where the crease is permanently set in the envelope blank 70.

SHEET SUPPORT FRAME

With conventional plowshare-type folders, the plowshare includes a blade having a surface that acts on the entire width of the flap being folded to form the fold by bending the flap in a tubular configuration. This requires that the blade have a surface area to support the entire width of the flap. The bending of the flap then commences at the free edge of the flap which is spaced the furthest point on the flap from the score line. When the bending forces are applied to the flap at this distance from the score line, the potential for misfolding the flap is the greatest.

One prior art approach to envelope blank folding is to construct the blade or forming surface of the plowshare to meet the dimensions of the side flap. This approach may be moderately successful for side flaps that do not exceed, for example, 2½ inches in width. However, problems occur with this approach in accurately controlling the flap folding operation when the width of the flap approaches, for example, 10 inches as encountered with large opened end envelopes.

With the present invention, the active surface of the plowshare 48 is confined to the convex profile face 112. The face 112 extends the length of the plowshare. The face 112 has a relatively short active width that extends upwardly from the folding edge 62 along a radial path. The width of the convex face 112 for most envelope blanks is less than the width of the flap to be folded.

In one embodiment of the present invention, the width of the face 112 upwardly from the edge 62 along the radial path is approximately 2 inches. This is the active surface of the plowshare 48 in the present invention regardless the width of the flap to be folded. The flap width may vary between about 2 inches to 10 inches and wider.

Regardless the width of the flap 72, the plowshare 48 of the present invention is capable of completing a fold where the forces applied to the flap are initiated at the leading edge 88 closely adjacent to the score line 76. The plowshare 48 of the present invention deviates from the prior art plowshares having an active surface that supports the entire width of the flap. The active surface of the plowshare 48 has a relatively short width. Therefore, the sheet support apparatus 50 serves as an extension of the face 112 to support the free edge 92 of the flap 72 as the body of the flap adjacent to the score line 76 is folded.

The sheet support apparatus 50 includes a support frame 130 as schematically illustrated in FIGS. 1–3 and extends substantially the length of the plowshare 48. The support frame 130 begins downstream of the plowshare receiving end portion 64 and ends upstream from the plowshare discharge end portion 66. In accordance with the present invention, the support frame 130 is mounted on the guide bar 60 to form a support surface for the portion of the side flap 72 that is not actively engaged by the convex plowshare face 112.

It is a feature of the present invention that by concentrating the forces for folding the flap 72 at the blank leading edge 88 adjacent to the score line 76 the entire width of the flap is not required to be actively folded. The prior art devices bend the entire flap into a tubular configuration to form the fold. This requires active folding of the entire flap width which becomes difficult for flap widths above three inches. For the reasons discussed above, this method of folding the flap is difficult to control, and misfolding is frequently encountered.

With the present invention, the folding is effectively controlled by confining the active surface of the plowshare 48 to a portion of the flap width and not the entire flap width. The plowshare convex face 112 applies the folding forces on the flap at the point where the flap is the weakest which point corresponds to the score line 76. Because the plowshare face 112 concentrates the folding forces on only a portion of the flap 72, the remaining portion of the flap is only required to be supported to follow the flap leading edge 88 as it is being folded. The folding forces are not applied to the entire surface area of the flap. Once the folding is initiated adjacent to the score line 76, the remaining portion of the flap follows the formation of the fold on the score line 76. In one example, the side flap 72 is engaged by the convex face 112 for a width of about 2 inches. The remaining width of the side flap 72 lies on the surface of the support frame 130.

Figure 19:
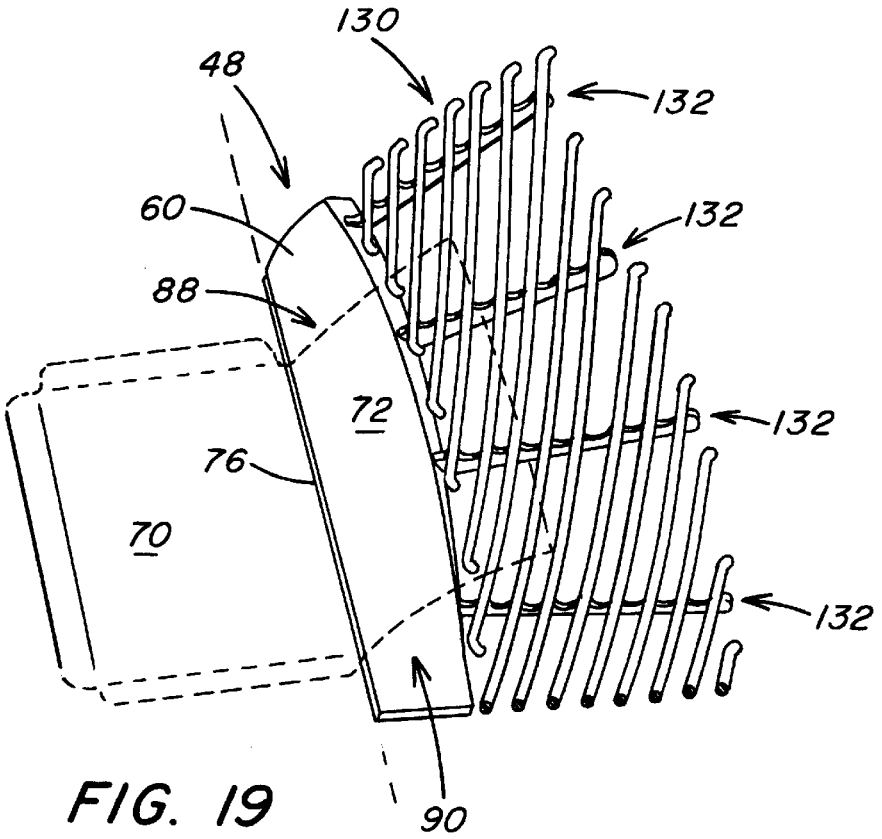
FIG. 19 is a schematic isometric view of a portion of the plowshare, illustrating the free edge of the blank supported by a grid which follows the helical path of the plowshare.
Figure 20:
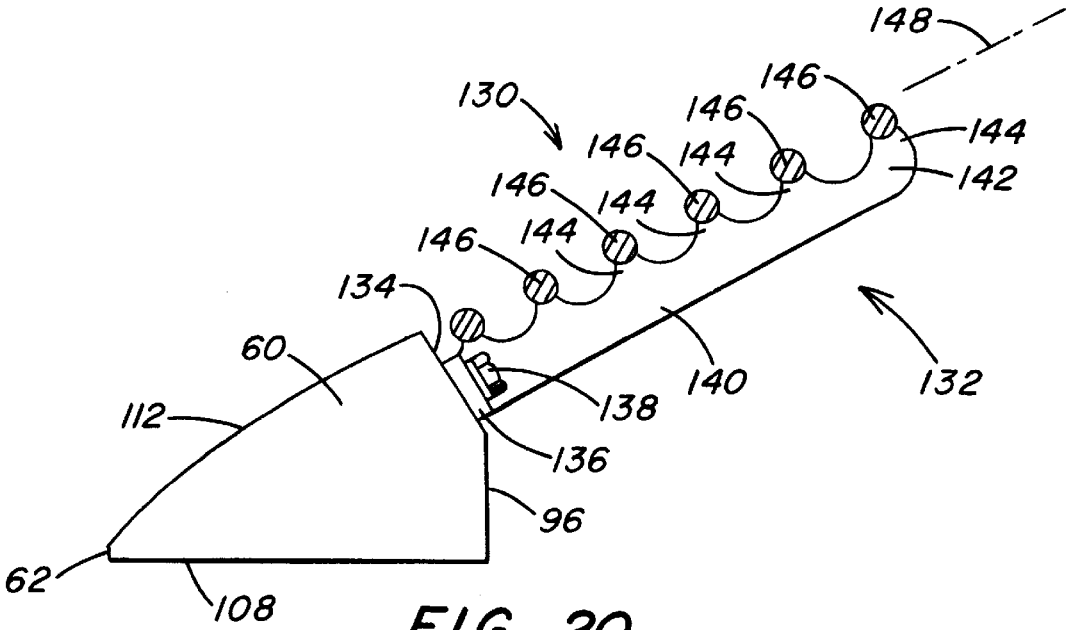
FIG. 20 is a partial sectional view in side elevation of the plowshare, schematically illustrating a plurality of support rods which form an extension of the plowshare to support the free edge of the flap.

As schematically illustrated in FIGS. 19 and 20, the support frame 130 includes a plurality of brackets 132 mounted in spaced relation along the length of the plowshare 48. The plowshare bar 60, as described above, includes the convex face 112 formed on a radius which intersects at its upper edge a bracket mounting surface 134. The angle at which the mounting surface 134 intersects the convex face 112 is constant along the entire length of the plowshare 48 so that the brackets 132 are positioned on the plowshare to form a supporting surface that approximates an extension of the convex surface of the face 112. To support the brackets 132 in this position, the surface 134 is substantially perpendicular to a line tangent to the convex face 112 at the point where the face 112 intersects the surface 134.

Each bracket 132, as shown in FIG. 20, includes a base portion 136 at one end portion through which a bolt 138 extends into the plowshare bar 60. An arm member 140 extends from the base 136 and includes a ridged upper surface 142 formed by a plurality of recessed seats 144 positioned in spaced relation the length of the arm member 140. The seats 144 have a configuration adapted to receive and secure in place a plurality of flexible, elongated elements 146, such as wires, rods, splines, and the like. The flexible elements 146 are received on the seats 144 to connect the brackets 132 to form an expanded platform that projects from the upper edge of the convex plowshare face 112.

The brackets 132 are bolted to the plowshare bar 60 to position the elongated elements 146 to form a supporting surface that lies in a plane coextensive with the convex face 112. The elements 146 connect adjacent brackets 132. With this arrangement, the supporting surface formed by the brackets 132 and elements 146 extends the supporting surface of the plowshare 48 beyond the active convex face 112. While the face 112 is convex, the elements 146 lie in a plane 148, as illustrated in FIG. 20, which substantially follows the radial path of the face 112 to form an extension of the active face 112.

Preferably the flexible elements 146 are spaced apart to form a grid that is pitched upwardly. The flap free edge 92 lies on this grid. The grid supports the flap free edge 92 without snagging the edge. In essence, the flap 72 combs across the surface of the elements 146 as the blank 70 advances along the plowshare 48.

While the flexible elements 146 supported by the brackets 132 extend the active surface of the face 112, the elements 146 do not act on the flap 72 to generate the folding forces. The elements 146 support the flap free edge 92 and trailing edge 90 to follow the helical path generated by the active face 112 bending the flap 72 adjacent to the score line 76. Consequently the entire width of the flap 72 is supported but without the requirement of applying bending forces to the flap free edge 92.

By confining the bending forces to the area immediately adjacent to the score line 76, formation of the fold about the score line 76 is most efficiently accomplished. Again this permits the bending forces to be applied to the area of the flap which has the least resistance to bending, i.e. at the score line, and not at the outer free edge 92 of the flap 72. With this method of supporting the free edge of the flap 72, the plowshare 48 can accommodate envelope blanks with a wide range of flap widths without having to construct a plowshare with an active face that supports an entire width of the flap 72.

The grid arrangement of elongated elements 146 supported by the spaced brackets 132 extends the active face of the plowshare by a lightweight frame which is easily erected. The frame 130 provides a supporting surface that accommodates a wide range of flap widths. By mounting all the brackets 132 in the same angular position on the mounting surface 134, the supporting surface formed by the grid of wire elements 146 follows the helical path of the face 112 as schematically illustrated in FIGS. 1–3. As seen in FIGS. 7–11 the mounting surface 134 is always positioned in a plane perpendicular to a line tangent to the point where the convex face 112 intersects the surface 134. This assures that the brackets 140 are mounted in a position to support the elements 146 to follow the helical path of the convex face 112.

The grid-like structure of the support frame 130 as seen in FIG. 19 permits unobstructed observation of the envelope blank as it advances the length of the plowshare 48. With conventional blade-type plowshares where the blank is rolled into a tubular form, viewing the folding operation is partially obstructed. However, with the present invention viewing the plowshare face 112 is not obstructed by the support frame 130. The operator is able to observe at all times folding of the flap along the intended score line.

The support frame 30 stabilizes the flap during the folding operation and the envelope blank is viewable through the grid-like structure of the support frame 130 as the blank advances along the face 112 of the plowshare 48. In the event blanks become jammed in the folding mechanism 10, the operator can readily locate the point where the jam has occurred because the folding operation is not concealed. It is completely visible along the entire length of the plowshare 48. Also the operator is able to observe at all times whether the flap 72 is being folded in alignment with the score line 76. These advantages apply regardless of the size of the envelope blank and the width of the flap being folded.

SHEET CONTROL GUIDE

During the folding operation the blank trailing edge 90 does not come in contact with the plowshare face 112. The edge 90 follows the folding path of the blank leading edge 88 through the 180° helical path. During the folding cycle, the trailing edge 90 has a tendency to be thrown downwardly and forwardly of the movement of the blank leading edge 88. The leading edge 88 adjacent to the score line 76 remains in contact with the plowshare face 112. The free edge 92 of the flap above the face 112 is supported by the support frame 130. The sheet control guide 50 resists the tendency of the flap trailing edge 90 to move downwardly toward the plane 110 of the blank 70 as the leading edge 88 is folded on the score line 76. It is important to maintain movement of the flap trailing edge 90 behind the leading edge 88; otherwise, the flap 72 will move out of control and the fold will not be completed on the score line 76, resulting in misfolding flap 72.

Figure 21:
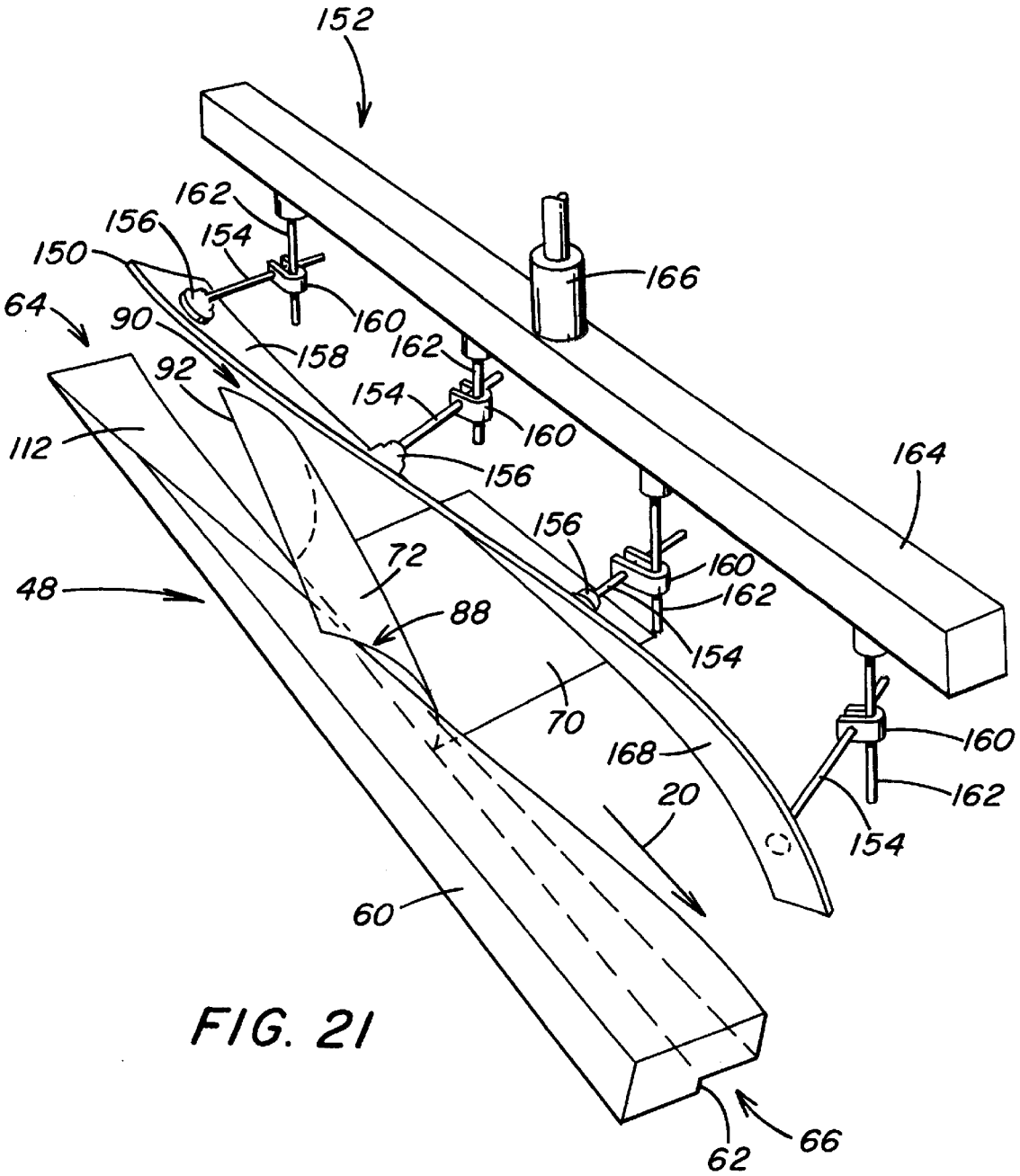
FIG. 21 is an isometric view of the plowshare, illustrating a sheet control guide for stabilizing the trailing edge of the blank as the leading edge of the blank is progressively folded through an angle of 180°.

As the flap trailing edge 90 follows the leading edge 88, the trailing edge 90 is displaced from the plowshare 48 and the support frame 130 a distance which is approximately equal to the change in the angle of the helix over the length of the envelope blank 70. The control guide 50 includes a flexible plate 150 that is supported by a frame 152 connected to the guide 42 which is adjustably positioned on the bridge 30 shown in FIG. 1. The frame 152 supports the plate 150 to follow a helical path as shown in FIG. 21.

The guide plate 150 is maintained spaced from the support frame 130 a distance which is approximately equal to the change in the angle of the helix formed in the blank between the leading edge 88 and the trailing edge 90 as the blank is folded. By maintaining the guide plate 150 in this position relative to the support frame 30, the flap trailing edge 90 is prevented from falling away from the plowshare 48 and "out running" the flap leading edge 88.

For envelope blanks with flaps having a width, for example of 10 inches, the flap trailing edge 90 has a tendency to move ahead of the leading edge 88. The problem of the trailing edge 90 running out of control is also encountered due to the effects of air currents generated when the envelope blanks are fed at relatively high speed through the folding mechanism 10.

The sheet control guide 50 is adjustably positioned on the frame 152 by the provision of a plurality of support rods 154 which are connected by swivel attachments 156 to a rear surface 158 of the plate 150. The opposite ends of the rods 154 are adjustably connected to clamps 160 that are, in turn, adjustably mounted for vertical movement on members 162 that extend downwardly from a horizontal bar 164 that runs substantially parallel to the feed path 20. The bar 164 is connected by a coupling 166 to the guide 42 that is slidably mounted on the bridge 30 for transverse movement relative to the feed path 20.

With the above described arrangement, the plate 150 is movable in a first direction transverse to the feed path 20 on the bridge 30 and vertically relative to the plane 110 of the envelope blank 70. Due to the flexible nature of the plate 150 along its length the rods 154 are extended from the clamps 160 to position a front surface 168 of the plate 150 in a preselected position relative to the plowshare face 112 and the support frame 130. The swivel connection of the rods 154 to the flexible plate 150 permits the plate to be positioned at selected distances relative to the surface of the support frame 130 along the length of the plate 150 in the feed path 20.

The flexible guide plate 150 follows the helical path subscribed by the plowshare face 112. The plate 150 is positioned a preselected distance from the support frame 130. The distance between the flexible plate 150 and the support frame 130 is approximately equal to the change in the angle in the helix formed in the envelope blank during the folding operation between the blank leading edge 88 and the trailing edge 90.

As seen in FIG. 21, the plate 150 extends in a helical path which is complementary to the helical path followed by plowshare 48. With the flap leading edge 88 maintained in contact with the plowshare face 112 and the flap free edge 92 supported by the support frame 130, the flap trailing edge 90 is displaced from the plowshare 48 and the support frame 130. Uncontrolled forward movement of the trailing edge 90 is restrained by contact with the plate 150.

As the flap 72 advances the length of the plowshare 48, the leading edge 88 does not contact the guide plate 150. However, the flap trailing edge 90 contacts the plate 150 and is prevented from bending forwardly ahead of the leading edge 88. This arrangement assures that the trailing edge 90 does not run out of control and cause the blank to become misaligned in the feed path. With provision of the sheet control guide 50, the flap trailing edge 90 remains in position to assure precise folding of the flap 72 on the score line 76.

According to the provisions of the patent statutes, we have explained the principle, preferred construction, and mode of operation of our invention and have illustrated and described what we now consider to represent its best embodiment. However, it should be understood that within the scope of the appended claims, the invention may be practiced otherwise than as specifically illustrated and described.

We claim:

1. Sheet folding apparatus comprising, transport means for linearly advancing a sheet of material in a feed path, said sheet material having a longitudinal score line, folding means positioned above said transport means for folding a sheet edge portion of the sheet material to form a flap in the sheet material as the sheet material is advanced in the feed path, a receiving end portion and a discharge end portion of said folding means spaced a preselected distance apart in the feed path where the sheet material is folded through an angle of 180° from said receiving end portion to said discharge end portion, said folding means including a guide bar extending between said receiving end portion and said discharge end portion, said guide bar having a base with a longitudinally extending folding edge positioned in parallel adjacent relation to the score line for locating the fold of the sheet material, a face of the guide bar extending upwardly from said folding edge at a preselected angle to form a profile evolving in a helical path the length of said bar from 0° at said receiving end portion to 180° at said discharge end portion to urge a leading edge of the sheet edge portion of the sheet material into contact with said folding edge to fold the sheet edge portion along the score line to form the flap, and resilient means extending upwardly at a preselected angle from said guide bar face for supporting a free edge of the sheet edge portion and direct the free edge to follow the sheet edge portion being folded at the score line.

2. Sheet folding apparatus as set forth in claim 1 which includes, said guide bar face having a convex surface positioned above said guide bar folding edge.

3. Sheet folding apparatus as set forth in claim 2 which includes, said convex surface having a preselected radius, said convex surface extending longitudinally on said transport means in a helical path, and said helical path extending through an angle of 180°.

4. Sheet folding apparatus as set forth in claim 3 in which, said helical path begins at said receiving end portion at an angle of 0° relative to the plane of the feed path and ends at said discharge end portion at an angle of 180° relative to the plane of the feed path.

5. Sheet folding apparatus as set forth in claim 1 in which, said guide bar folding face applies a bending force to a leading edge of the sheet material adjacent to the score line to initiate folding of the flap along the score line with a free edge of the flap and a trailing edge of the flap following the leading edge advancing in the helical path.

6. Sheet folding apparatus as set forth in claim 1 which includes, a support frame extending above said transport means for positioning said guide bar base coplanar with the sheet material in the feed path and said folding edge in alignment with the score line.

7. Sheet folding apparatus as set forth in claim 6 which includes, means for connecting said folding means to said support frame to move said folding edge to a position to engage the sheet material at the leading edge thereof and apply a bending force to the leading edge to fold the sheet material along the score line and form the flap.

8. Sheet folding apparatus as set forth in claim 1 which includes, means positioned oppositely of said guide bar folding edge for maintaining a portion of the sheet material opposite the flap to be formed in contact with said transport means so as to maintain the sheet material in position for folding the edge portion of the sheet material along the score line.

9. Sheet folding apparatus as set forth in claim 1 which includes, sheet control means positioned in spaced relation oppositely of said folding means for controlling movement of a trailing edge of the sheet material in the feed path as the leading edge of the sheet material is engaged by said guide bar face, and said sheet control means having a surface extending in the feed path and following a helical path complementary to the helical path of said guide bar face for restraining forward movement of the trailing edge to remain rearwardly of the leading edge and follow the folding movement of the leading edge.

10. Sheet folding apparatus as set forth in claim 1 which includes, said resilient means for resiliently supporting the free edge of the sheet edge portion forming an extension of said profile of said guide bar face as said guide bar face follows the helical path.

11. Sheet folding apparatus as set forth in claim 1 in which, said means for resiliently supporting the free edge of the sheet edge portion includes a plurality of flexible elongated members forming a grid lying in a plane following the helical path of said guide bar face along the feed path, and means for mounting said flexible elongated members on said guide bar to follow the helical path and resiliently support the free edge of the sheet edge portion as said folding face applies bending forces upon the sheet edge portion adjacent to the score line.

12. Sheet folding apparatus as set forth in claim 11 which includes, said guide bar face having a convex surface, said flexible elongated members extending upwardly from said guide bar face to form said grid having a convex surface coplanar with said convex surface of said guide bar face, and said grid convex surface following the helical path of said guide bar along the feed path.

13. Sheet folding apparatus as set forth in claim 12 which includes, means for connecting said grid coplanar with said convex surface of said guide bar face to resiliently support the free edge of the sheet edge portion for movement in a helical path as the sheet edge portion is folded along the score line.

14. A method for folding sheet material comprising the steps of, advancing a sheet of material for folding in a feed path, positioning folding means in the feed path to fold a sheet material edge portion of the advancing sheet material along a longitudinally extending score line to form a flap in the sheet material, feeding the sheet material with the score line maintained in contact with an edge of a folding face of the folding means with the folding face extending in a helical path commencing at 0° at the beginning of the fold to 180° at the end of the fold, folding the sheet material at the score line adjacent the folding face edge as the sheet material edge portion moves in a helical path on the folding face, resiliently supporting a free edge of the sheet material extending above the folding face to follow the helical path of the folding face as the sheet material is folded along the score line, initiating the fold in a body of the sheet material at the point where the folding face edge engages the score line with the sheet material free edge following the direction of fold as the sheet material edge portion advances on the folding face in the helical path, the folding face having a convex surface extending upwardly from the folding face edge and following a longitudinal helical path parallel to the feed path, positioning the folding face edge of the convex surface in the plane of the sheet material and aligned with the score line, applying a bending force by the folding face upon the sheet material edge portion adjacent the score line to initiate folding the sheet material as the sheet material advances longitudinally in the helical path on the folding face, and resiliently supporting the free edge of the sheet material projecting above the folding face on a surface coplanar with the convex surface of the folding face and following the longitudinal helical path of the folding face.

15. A method for folding sheet material as set forth in claim 14 which includes, maintaining the body of the sheet material adjacent to the edge portion being folded in contact with the feed path and restrained from being lifted upwardly to assure folding the edge portion on the score line.

16. Apparatus for folding a flap on a blank of sheet material comprising, an elongated bar having an integral base portion, a profile surface, and a folding edge, said base portion extending longitudinally in the feed path of a blank of sheet material, said base portion having a blank receiving end portion and a blank discharge end portion, said profile surface extending upwardly from said base portion, said folding edge formed at the intersection of said base portion and said profile surface, said folding edge extending the length of said base portion from said receiving end portion to said discharge end portion, said profile surface having a convex configuration extending in a radial path upwardly from said base portion transverse to said folding edge, said profile surface following a helical path through an angle of 180° beginning at an angle of 0° relative to the feed path at said receiving end portion and terminating at an angle of 180° relative to the feed path at said discharge end portion, a grid of flexible elongated members extending upwardly from said bar to resiliently support a free edge portion of the blank as said profile surface engages the blank and bends the blank in the helical path on a score line to form a flap folded along the score line, and said grid members mounted to conform to the convex configuration of said profile surface and follow the helical path of said profile surface.

17. Apparatus for folding a flap on a blank of sheet material as set forth in claim 4 which includes, means for connecting said grid members to said bar to form an extension of said profile surface along the length of said bar.

* * * * *